US009240167B2

(12) United States Patent
Caccia

(10) Patent No.: US 9,240,167 B2
(45) Date of Patent: Jan. 19, 2016

(54) PICK-RITE GUITAR AID

(71) Applicant: Kay Caccia, Bagley, MN (US)

(72) Inventor: Kay Caccia, Bagley, MN (US)

( * ) Notice: Subject to any disclaimer, the term of this patent is extended or adjusted under 35 U.S.C. 154(b) by 0 days.

(21) Appl. No.: 14/553,220

(22) Filed: Nov. 25, 2014

(65) Prior Publication Data

US 2015/0143973 A1 May 28, 2015

Related U.S. Application Data

(60) Provisional application No. 61/908,572, filed on Nov. 25, 2013.

(51) Int. Cl.
*G10D 3/16* (2006.01)

(52) U.S. Cl.
CPC ..... *G10D 3/163* (2013.01)

(58) Field of Classification Search
CPC ..... G10D 3/163; B32B 37/16
USPC ..... 84/320–322
See application file for complete search history.

(56) References Cited

U.S. PATENT DOCUMENTS

| | | | | |
|---|---|---|---|---|
| 756,348 | A | 4/1904 | Forney | |
| 1,787,136 | A | 12/1930 | Beauchamp | |
| 2,063,011 | A | 12/1936 | Bell | |
| 2,221,234 | A | 11/1940 | Frasier | |
| 2,776,592 | A * | 1/1957 | Di Preta | 84/322 |
| 3,442,169 | A | 5/1969 | Bowers | |
| 3,648,558 | A | 3/1972 | Chenette | |
| 3,699,838 | A | 10/1972 | Montgomery | |
| 3,789,720 | A | 2/1974 | McIntyre | |
| 4,020,732 | A | 5/1977 | Kelly | |
| 4,270,433 | A | 6/1981 | Adamec | |
| 4,625,616 | A | 12/1986 | McVicker | |
| D291,809 | S | 9/1987 | Jasper | |
| 4,867,032 | A | 9/1989 | Lukehart | |
| 4,879,940 | A | 11/1989 | Pereira | |
| 5,323,677 | A | 6/1994 | Knutson | |
| 5,509,341 | A | 4/1996 | Dunlop | |
| 5,864,075 | A | 1/1999 | Mapson | |
| 5,973,243 | A | 10/1999 | Christenson | |
| 5,981,857 | A | 11/1999 | Mapson | |
| 6,335,477 | B1 | 1/2002 | Miller | |
| 6,797,871 | B2 | 9/2004 | Atkin | |
| 6,949,700 | B1 | 9/2005 | Kelly | |
| 6,977,330 | B2 | 12/2005 | Santa Cruz et al. | |
| 7,157,635 | B2 | 1/2007 | Sogabe | |
| 7,179,976 | B2 | 2/2007 | West | |
| 7,312,386 | B2 | 12/2007 | Sielaff et al. | |
| 7,371,950 | B2 | 5/2008 | Benyahia et al. | |
| D603,891 | S | 11/2009 | Whetstine | |

(Continued)

*Primary Examiner* — Kimberly Lockett
(74) *Attorney, Agent, or Firm* — Patterson Thuente Pedersen, P.A.,

(57) ABSTRACT

A guitar aid enables a user to selectively position and control tension and angle of a guitar pick for a richer sound with decreased strain on the user's hand and fingers. The guitar aid includes a band that can be adjustably sized to fit a user's finger. A guitar pick can be coupled directly to the band. The guitar pick can define a raised portion or ridge on the upper surface of the pick that serves as a first engagement feature for a first user finger, such as the user's thumb. The lower surface of the pick can include at least one outwardly projecting rib that serves as a second engagement feature for a second user finger, such as the user's index finger. The positioning of the pick with respect to the ring and the pair of engagement features cause a user to hold the pick at the proper angle and with appropriate tension when playing a guitar or other stringed instrument.

14 Claims, 7 Drawing Sheets

(56) References Cited

U.S. PATENT DOCUMENTS

| | | | |
|---|---|---|---|
| 7,786,362 | B1 | 8/2010 | Whetstine |
| D632,725 | S | 2/2011 | Goad |
| 7,977,557 | B2 | 7/2011 | Broderick |
| 8,263,845 | B2 | 9/2012 | Mcdonald |
| 8,389,838 | B2 | 3/2013 | Aletto et al. |
| 2002/0178891 | A1 | 12/2002 | Atkin |
| 2005/0204893 | A1 | 9/2005 | Luschniu |
| 2005/0211053 | A1* | 9/2005 | Ball ..... 84/322 |
| 2008/0178725 | A1 | 7/2008 | Goad |
| 2009/0056521 | A1 | 3/2009 | Goad |
| 2009/0084244 | A1 | 4/2009 | Goad |
| 2009/0139384 | A1 | 6/2009 | Bramucci |
| 2010/0263515 | A1 | 10/2010 | Hollin, Jr. |
| 2012/0260788 | A1 | 10/2012 | Leneman |

* cited by examiner

PICK-RITE GUITAR AID

RELATED APPLICATION

The present application claims the benefit of U.S. Provisional Application No. 61/908,572 filed Nov. 25, 2013, which is incorporated herein by reference in its entirety.

FIELD OF THE INVENTION

The present invention relates to the use of a guitar pick for playing stringed instruments and more particularly, to a guitar aid that provides a user with the ability to apply a controlled tension while maintaining a fixed position of the guitar pick while playing a guitar or other stringed instrument.

BACKGROUND OF THE INVENTION

Guitar picks are typically small, flat apparatuses that are triangular shaped with rounded edges. The pick can be used to pluck or strum stringed musical instruments such as guitars. Use of a guitar pick can help generate a higher quality sound and improve the ability of a musician to strike large chords. A pick is generally made of a rigid material such as metal or plastic and is lightweight and may vary in thickness based on the desired sound quality.

Conventionally, picks have been designed to be held between the thumb and one or more fingers to assist musicians while playing instruments such as the guitar. Drawbacks of this technique, however, include difficulty of maintaining a fixed position and proper control of the pick and proper tension on the pick while playing an instrument. For example, if the pick is held too loosely, it could cause the pick to shift in the musician's fingers, affecting the ability of the musician to retain a proper grip on the pick. Conversely, holding the pick too tightly can interfere with the play of the instrument by distorting the sound. Sound quality can also be negatively impacted if the pick is not held at a proper 90 degree angle to the strings.

Mounting apparatuses such as rings or band-like structures have been designed to secure a guitar pick onto a user's finger or thumb. Such designs, however, are directed towards preventing accidental dropping of a guitar pick and/or providing a user with the ability to interchangeably alternate between the use of a user's finger and a guitar pick to strum or pluck instrument strings. These designs do not address the issues of maintaining a proper tension and angle of a guitar pick relative to an instrument.

Therefore, there is a need for a guitar pick that aids in improving the ability of a musician to effectively control tension and alignment of a guitar pick without losing a sufficient grip on the guitar pick while maintaining a high quality tone.

SUMMARY OF THE INVENTION

A guitar aid enables a user to selectively position and control tension and angle of a guitar pick for a richer sound with decreased strain on the user's hand and fingers. The guitar aid includes a band that can be adjustably sized to fit a user's finger. A guitar pick can be coupled directly to the band. The guitar pick can define a raised portion or ridge on the upper surface of the pick that serves as a first engagement feature for a first user finger, such as the user's thumb. The lower surface of the pick can include at least one outwardly projecting rib that serves as a second engagement feature for a second user finger, such as the user's index finger. The positioning of the pick with respect to the ring and the pair of engagement features cause a user to hold the pick at the proper angle and with appropriate tension when playing a guitar or other stringed instrument.

In another embodiment, the guitar aid includes a pick retainer coupled to a band, the pick retainer being configured to secure a guitar pick to the guitar aid. The pick retainer may include clamping members into which the guitar pick can be snap fit and tension control elements. The tension control elements may include a thumb engagement member and an index finger engagement member configured to selectively control the tension applied to the guitar pick.

Certain embodiments are described further in the following description, examples, and drawings. These features of embodiments will become more apparent from the following detailed description when taken in conjunction with the accompanying exemplary drawings.

DETAILED DESCRIPTION OF THE DRAWINGS

Figure 1:
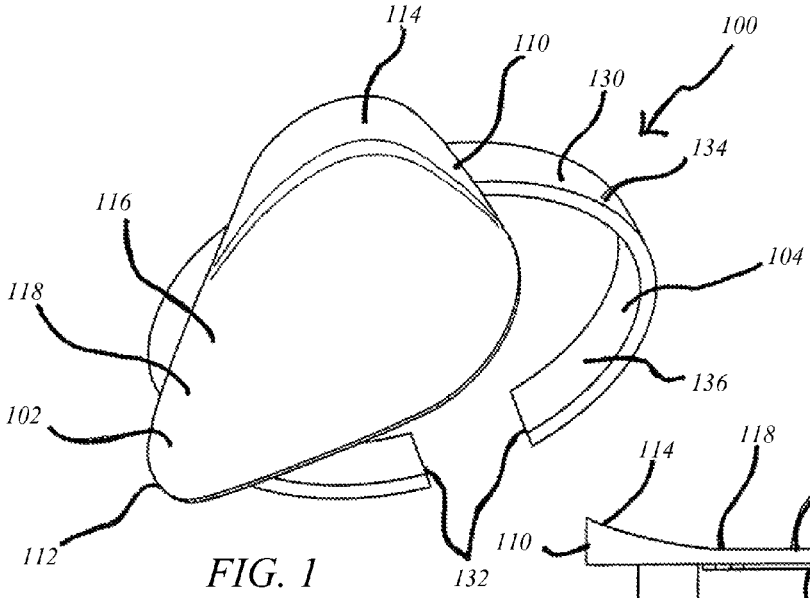
FIG. 1 is an isometric view of a guitar aid according to an embodiment of the present invention.
Figure 2:
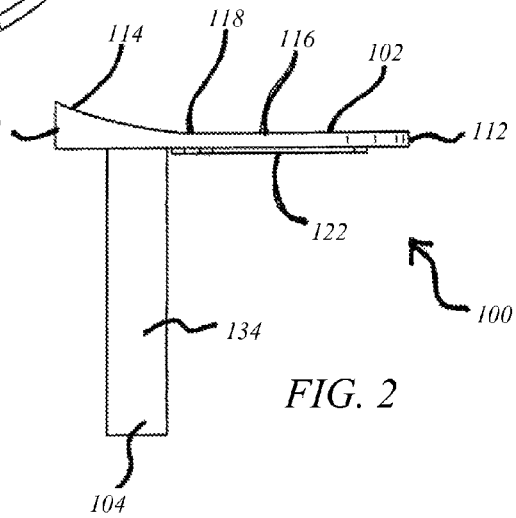
FIG. 2 is a front view of a guitar aid according to an embodiment of the present invention.
Figure 3:
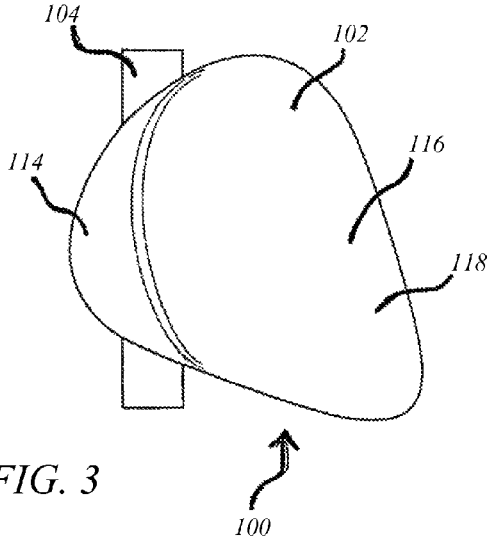
FIG. 3 is a top view of a guitar aid according to an embodiment of the present invention.
Figure 4:
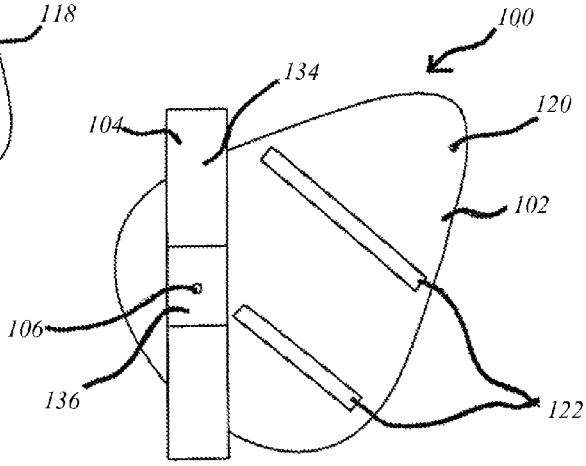
FIG. 4 is a bottom view of a guitar aid according to an embodiment of the present invention.

Referring to FIGS. 1-4, a pick-rite guitar aid 100 configured as a combination guitar pick and ring according to an embodiment of the present invention is depicted. Pick-rite 100 includes a guitar pick 102 and a band or ring 104. Guitar pick 102 can be permanently or semi-permanently attached to ring 104. In some embodiments, guitar pick 102 can be permanently joined to ring 104 with a rivet 106 (see FIG. 4). In other embodiments, ring 104 and pick 102 can be molded as a unitary construct. Guitar pick 102 can be provided in different thicknesses to cover standard pick sizes. In some embodiments, each differently sized guitar pick 102 is provided pre-attached to a different ring 104, which can be provided in a kit having multiple pick-rite guitar aids 100. In other embodiments, guitar pick 102 can be removed from ring 104 and a guitar pick 102 of a different thickness can be attached as desired. In such an embodiment, rivet 106 can be replaced by a screw or other easily removable/replaceable fastener.

Guitar pick 102 has an outer perimeter shaped to have a wider proximal end 110 with rounded corners and a tapered distal end 112 as with standard guitar picks. Pick 102 defines a raised portion or ridge 114 on the upper surface 118 of pick that angles upwardly from a main body portion 116 of pick and defines a portion of pick 102 that is thicker than main body of pick. This raised portion 114 provides an engagement feature for a user's finger, typically the thumb, that enhances a user's grip on the pick. In some embodiments, raised portion 114 is unitarily formed with body portion 116 of pick 102. The bottom surface 120 of pick 102 can define one or more ribs 122 that extend outwardly from bottom surface 120. These ribs 122 provide an engagement feature for another finger of the user that is inserted through the ring 104, typically the index finger, which further serves to enable a proper grip on and positioning of the pick. In various embodiments, a user's finger can extend across or along one or more ribs or between a pair of ribs. The combination of ridge 114 on upper surface 118 and rib(s) 122 on bottom surface 120 enables a user to maintain a firm grip on pick (i.e., so the pick does not slip around between the user's fingers) while not maintaining such a firm grip so as to decrease sound quality. In some embodiments, pick 102 can be comprised of a plastic or other polymer material. Pick body 116, raised portion 114 and ridges 122 can be molded, such as by injection molding, as a unitary construct.

Figure 5:
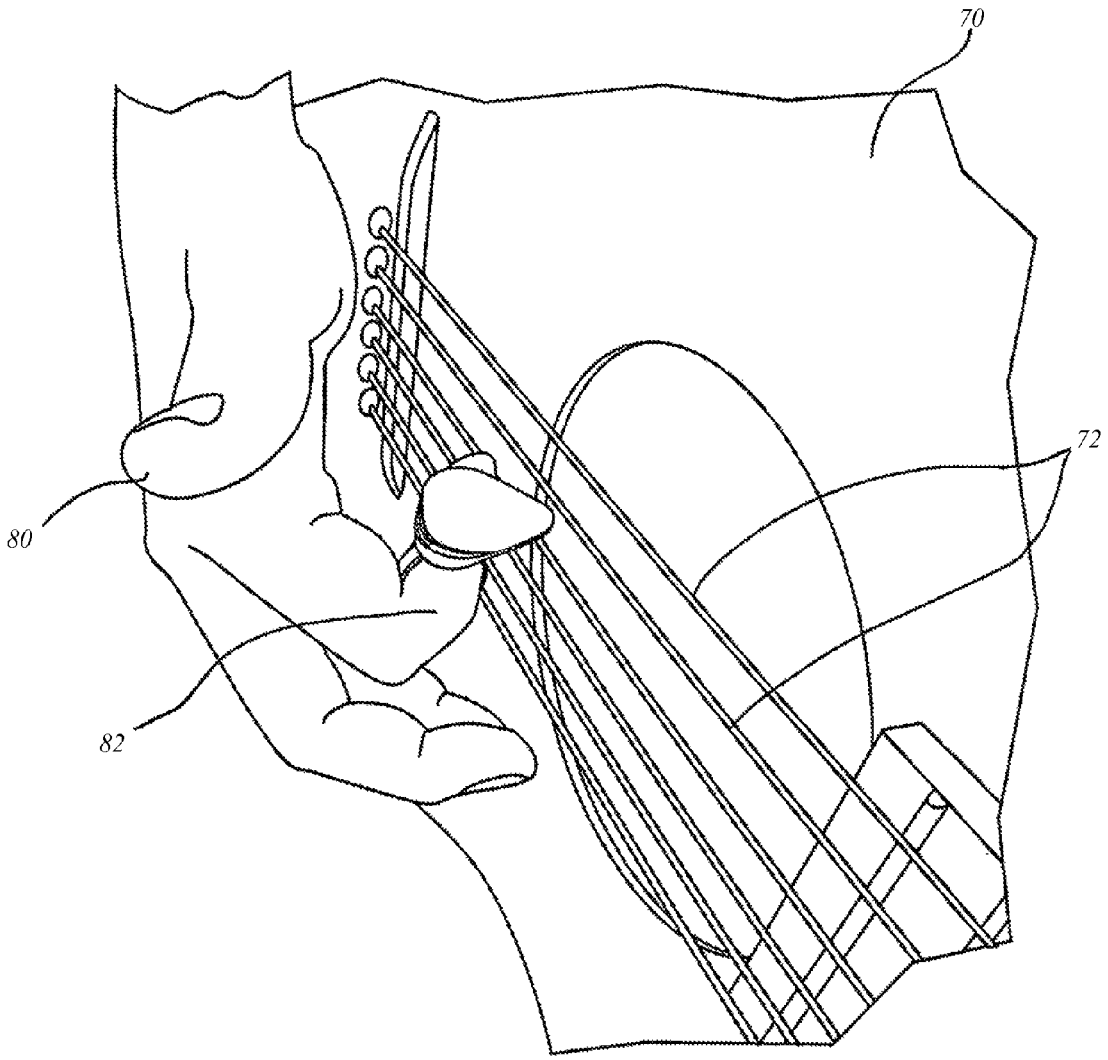
FIG. 5 depicts the guitar aid of FIGS. 1-4 positioned on the index finger of a user according to an embodiment of the present invention.

Ring 104 can comprise an arcuate body portion 130 having a pair of ends 132 defining a space therebetween. Body portion 130 includes an outer surface 134 to which the guitar pick 102 attaches and an inner surface 136 defining an opening for a user's finger (typically the user's index finger as shown in FIG. 5.) Ring 104 can be comprised of a pliable material such that ring can easily adjust to fit different finger sizes. The material can be any material having such flexibility, including polymer and metal materials. In some embodiments, ring can be injection molded. In alternative embodiments, ring 104 can comprise a complete circle of material.

As noted above, in some embodiments pick 102 can be attached to ring 104 with a rivet 106 or other fastener. The rivet 106 can extend upwardly through the inner surface 136 of the ring and into the bottom surface 120 of pick 102. Because the thicker ridge 114 is positioned adjacent a side of pick 102 near the attachment to ring 104 such that ridge 114 overlaps the attachment point, the fastener 106 can extend far enough into pick to securely attach the pick to the ring without protruding through the upper surface 118 of the pick. The pick 102, and more specifically the distal end 112 of pick 102, can extend at about a 45 degree angle relative to the ring 104, and specifically an axis defined by the opening through the ring (along which the user's finger would be inserted through the ring), as seen most clearly in FIG. 3 and FIG. 4. In other embodiments, the distal end 112 of the pick 102 can define a 30 degree angle, a 60 degree angle, or any angle in between with the axis of ring 104 opening. In some embodiments, fastener such as rivet 106 can be inserted in such a way that a limited amount of relative movement is enabled between the pick 102 and the ring 104. This enables the user to slightly swivel the pick 102 with respect to the ring 104 to a comfortable position for the user for grasping the pick 102.

Figure 6:
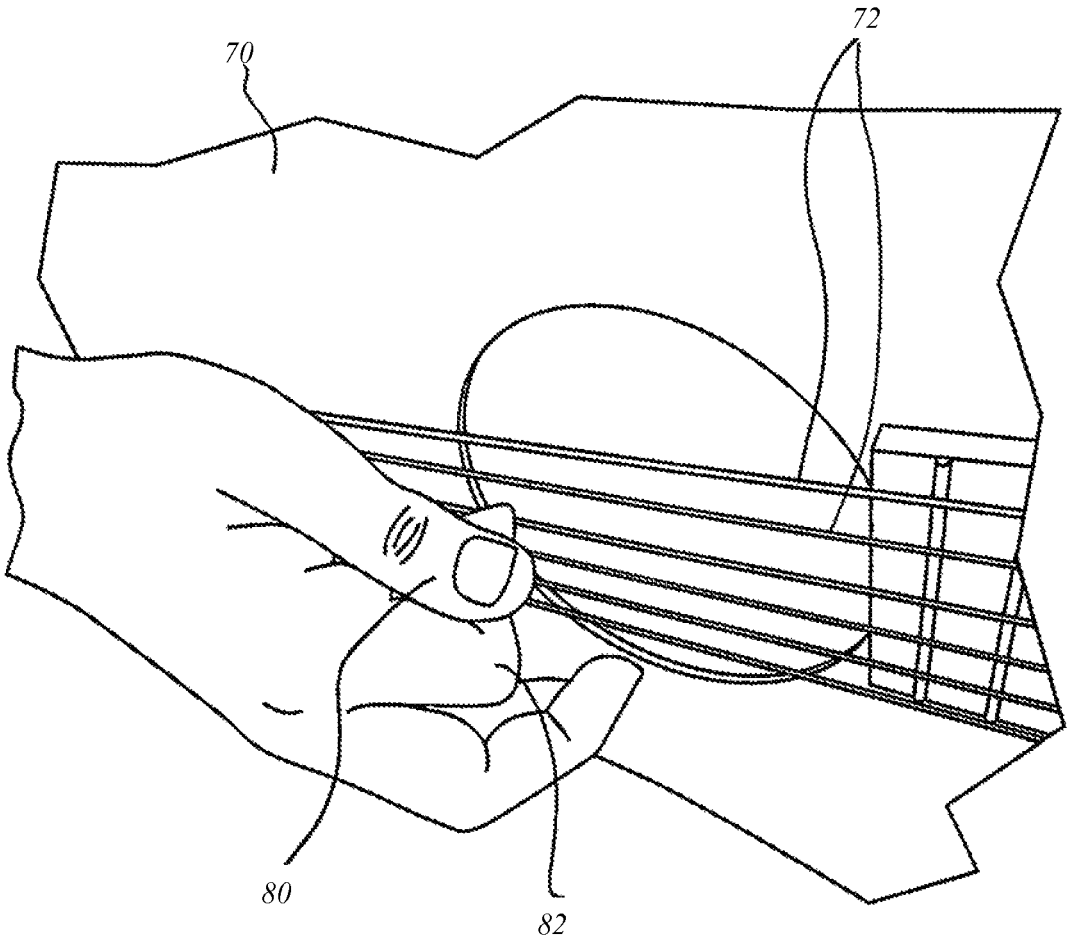
FIG. 6 depicts the guitar aid of FIG. 1-4 positioned at a 90-degree angle for strumming guitar strings according to an embodiment of the present invention.

In use, this orientation of the pick 102 with respect to the ring 104 causes the pick 102 to be positioned at an approximately 90 degree angle relative to the strings 72 of a guitar 70 as shown in FIG. 5 and FIG. 6. A user inserts the user's index finger 82 through the ring 104, which conforms to the size of the user's finger 82, and the user's index finger 82 interacts with ribs 122. The user grasps the upper surface of the pick 116, and particularly the raised portion/ridge 114, with the user's thumb 80. In this manner, the pick-rite guitar aid 100 of the present invention ensures proper alignment and a proper grip of the pick 102, which helps the user to not overuse the forearm muscles and aids in producing a proper sound from the guitar. This proper positioning and grip provided by the pick-rite guitar aid 100 can further function in teaching a beginner how to properly hold a guitar pick. In addition, the ring 102 allows a user to easily slide the pick-rite 100 up and down the user's finger to either grasp the pick 102 for playing the instrument or move the pick out of the way to utilize the user's fingers to play the instrument, with the pliable band conforming to the size of whatever portion of the user's finger on which it is positioned.

Figure 7:
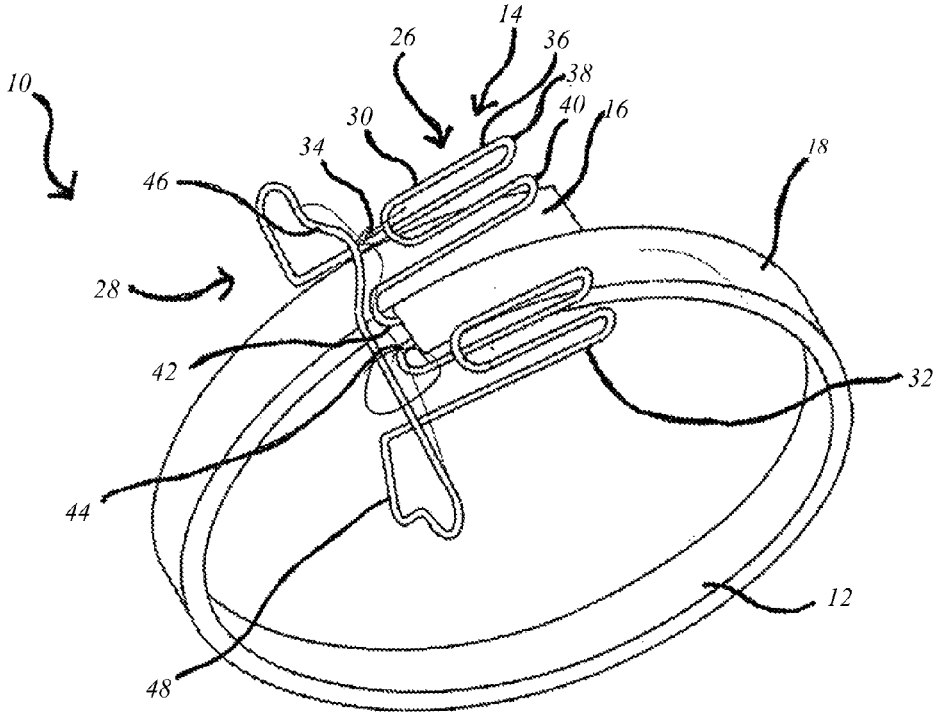
FIG. 7 is an isometric view of a guitar aid according to an embodiment of the present invention.
Figure 8:
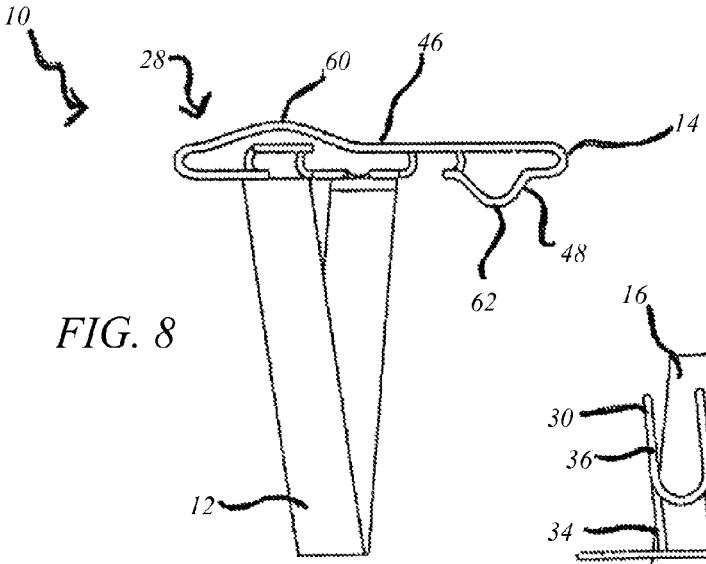
FIG. 8 is a front view of a guitar aid according to an embodiment of the present invention.
Figure 9:
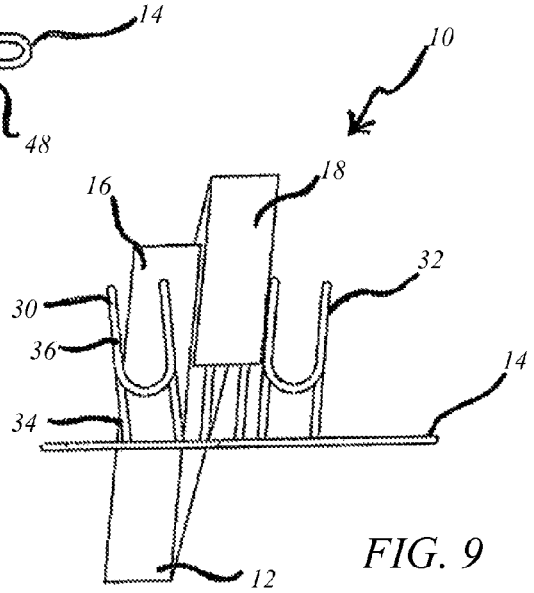
FIG. 9 is a top view of a guitar aid according to an embodiment of the present invention.

Referring to FIGS. 7-9, a guitar aid 10 according to an embodiment of the present invention is depicted. Guitar aid 10 comprises a band 12 that can be adjusted in size to fit a user's finger and a pick retainer 14. Band 12 of guitar aid 10 can be made from a variety of lightweight flexible materials that enable the band 12 to be easily adjusted to fit different fingers of an individual user or of different users. In some embodiments, band 12 comprises band members 16 and 18 formed as a part of a single unitary ring of material, the relative positioning of which is adjustable to change a size of an opening in band for a user's finger. Band members 16 and 18 can be arranged adjacent to one another with band member 16 horizontally offset from band member 18. To decrease the circumference of band 12, a user can apply inward forces to band members 16 and 18 to compress band 12. To increase the circumference of band 12, a user can apply outward forces to band members 16 and 18 to expand band 12.

Pick retainer 14 can be fixedly or removably mechanically coupled to band 12. Pick retainer 14 can comprise clamping member 26 and tension control element 28. Clamping member 26 can comprise a first wire loop 30 defining a first channel and a second wire loop 32 defining a second channel adapted to receive a guitar pick 50. In some embodiments, channel 30 and channel 32 are symmetrically arranged in relation to band member 18. The first channel 30 is defined by a bottom portion 34 and a top portion 36 interconnected by junctures 38 and 40 and is configured to provide a first support enclosure for guitar pick 50. The bottom portion 34 can be removably or fixedly coupled to band member 18 of band 12 by a first hook member 42. The design and structure of the second channel 32 is identical to the first channel 30 in this embodiment. Second channel 32 can similarly be removably or fixedly coupled to band member 18 of band 12 by a second hook member 44. In use, the design of first and second channels 30, 32 of pick retainer 14 allows for effortless and sustained placement of guitar pick 50 into pick retainer 14. In some embodiments, pick retainer 14 comprises a metal wire material, such as, for example, copper, aluminum, iron or steel. The distance between top portions 36 and bottom portions 34 of channels 30, 32 can vary for a given guitar aid such that different guitar aids have different channel 30, 32 widths for accommodating guitar picks of different widths. The pick retainer can retain the guitar pick within the retainer without the need for the user to hold the guitar pick in place in the retainer.

Referring to FIG. 8, a front view of the guitar aid 10 of FIG. 7 is shown. Tension control element 28 includes a thumb engagement member 46 and an index finger engagement member 48, adapted to be contacted by a user's thumb and index finger or other playing finger, respectively, when a guitar pick is coupled to the guitar aid 10 and the guitar aid 10 is positioned on a user's hand for playing the guitar. Thumb engagement member 46 can include a first protruding curve 60 that protrudes upwardly from pick retainer for contact with the user's thumb. In operation, a user's thumb engages thumb engagement member 46 during use and applies a pulling force on the protruded portion 60. Similarly, index finger engagement member 48 can include a second curved protrusion 62 that protrudes downwardly from pick retainer 14 for contact with and application of a pulling force by the user's index finger or other finger.

First 60 and second 62 protruding portions provide a user with the ability to maintain controlled and fixed tension on the guitar pick while playing a guitar to produce a consistent, full sound. During play, the user's thumb pulls back on the first protruding portion 60 as the user's index finger pulls back on the second protruding portion 62 to create the necessary tension. Thus, the first protruding portion 60 acts as a first tension control element and the second protruding portion 62 acts as a second tension control element.

Figure 10:
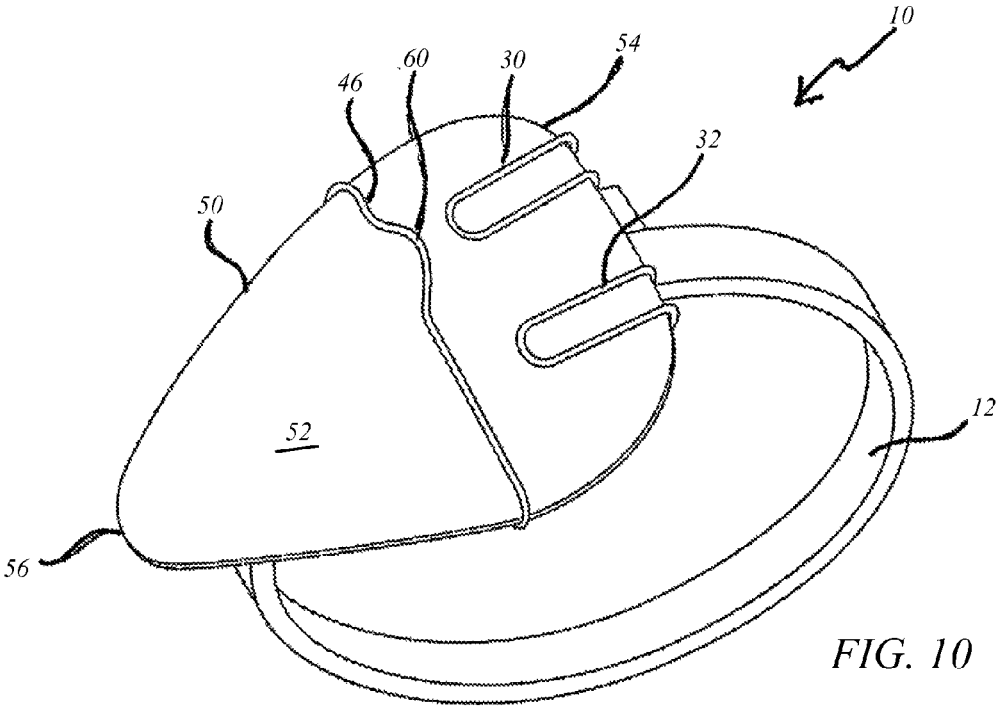
FIG. 10 is an isometric view of a guitar pick positioned within a guitar aid according to an embodiment of the present invention.
Figure 11:
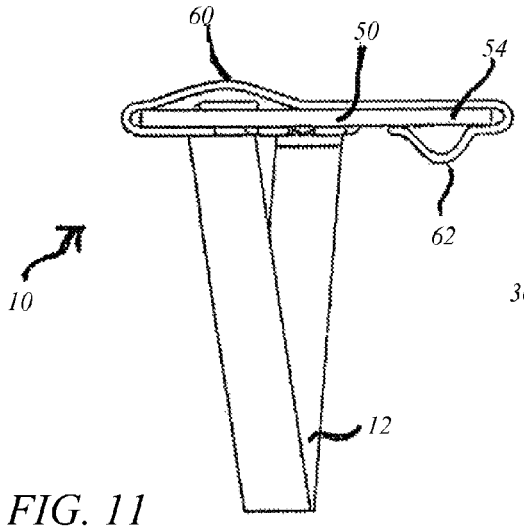
FIG. 11 is a front view of a guitar pick positioned within a guitar aid according to an embodiment of the present invention.
Figure 12:
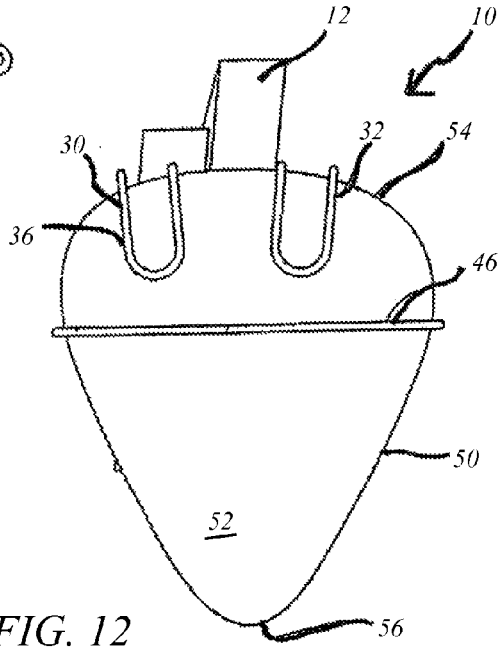
FIG. 12 is a top view of a guitar pick positioned within a guitar aid according to an embodiment of the present invention.

FIGS. 10-12 depict a conventional guitar pick 50 installed within and held by a pick retainer 14 according to an embodiment of the present invention. Guitar pick 50 can comprise a body 52 having a wider proximal end 54 and a narrower distal end 56. Body 52 of guitar pick 50 is inserted into pick retainer 14 such that the distal end 56 protrudes outwardly from pick retainer 14 for striking strings of a guitar or other stringed instrument. The proximal end 54 of body member 52 is inserted through a slotted opening of tension control element 28 and into channels 30 and 32 aligned with slotted opening, which securely hold the pick 50 in place. Thus, guitar pick 50 can easily be inserted into and retained within guitar aid 10 with a single sliding motion without the need for additional fasteners or other parts. The guitar pick 50 can similarly be removed from the guitar aid 10 by applying a pulling force on the distal end 56 of the pick without substantially distorting or moving any elements of the pick retainer.

As depicted in FIGS. 10-12, in some embodiments the guitar pick is held with a single strand of wire, thumb engagement member 46, extending horizontally across the pick. Similarly, index finger engagement member 48 can extend as a single strand of wire across the reverse surface of the pick. Use of this single strand configuration allows a user to feel the pick while playing almost as if the guitar aid 10 were not present, such that the guitar aid will not affect the quality of the guitarist's play, and also assists in providing the proper tension on the pick for proper sound. The thickness or gauge of the wire can vary, such as, for example between 10 gauge wire and 30 gauge wire. More specifically, the wire can be between 18 gauge wire and 20 gauge wire. In one embodiment, the wire gauge wire.

The relative positioning of the pick retainer 14 on the band 12 determines the angle of the guitar pick 50 held by guitar aid 10. For example, the pick retainer 14 and band 12 can be arranged such that that pick creates an acute angle of approximately 45 degrees with the user's finger when the user's hand is at rest. Such a configuration causes the pick to be at a 90 degree angle to guitar strings when the user is positioned to play the guitar, which is the optimum angle for proper sound quality. In alternate embodiments, the pick retainer 14 and band 12 can be arranged such the pick is oriented at any other angle to the guitar strings.

Figure 13:
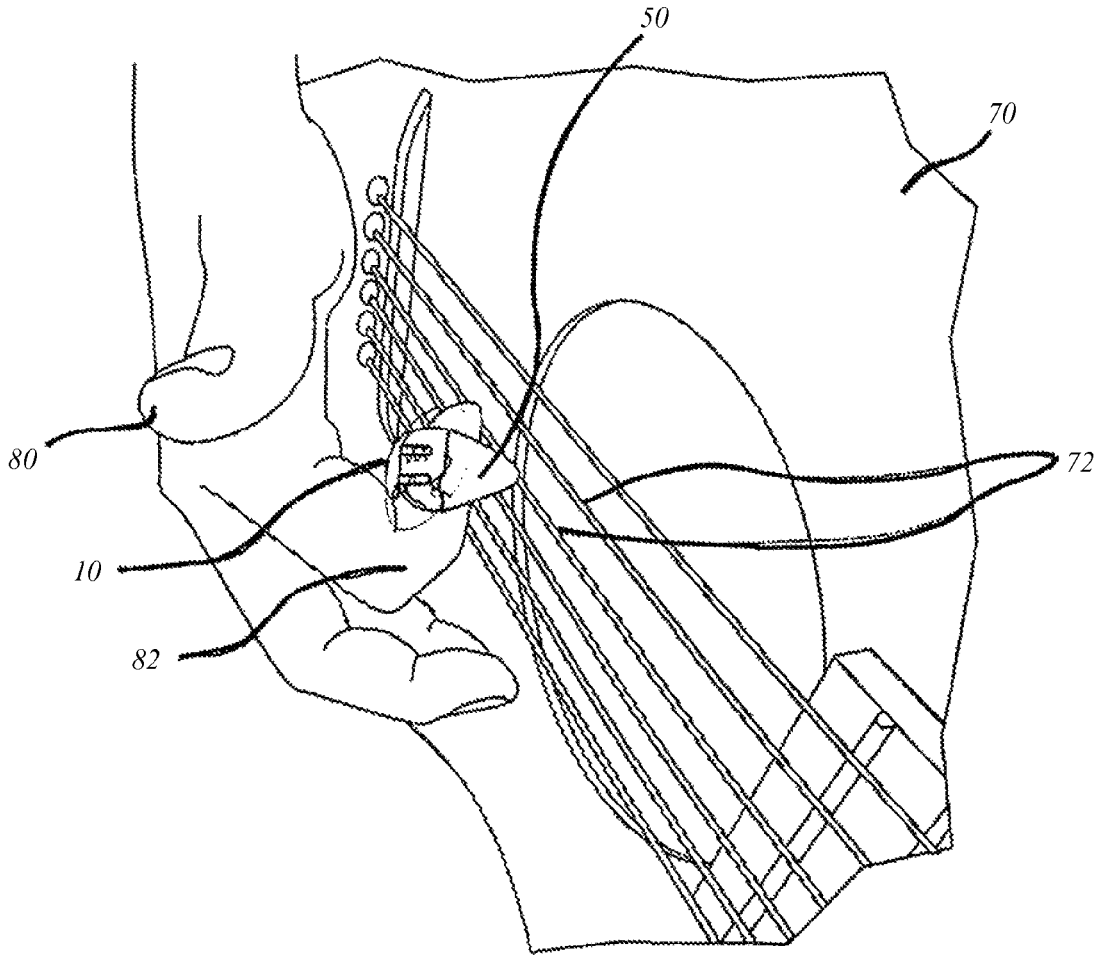
FIG. 13 is a drawing illustration of the guitar aid of FIGS. 7-12 positioned on the index finger of a user according to an embodiment of the present invention.

FIG. 13 depicts the combination of guitar pick 50 and guitar aid 10 aver it has been positioned on a user's finger. A user slides the tip of a finger, such as the index finger, through the band 12 of the guitar aid 10 such that a portion of the finger rests against guitar aid 10, with the user's finger contacting the index finger engagement portion 48. The resilience and flexibility of the material of pick retainer 14 allows it to conform to a variety of sizes of picks and fingers while holding the guitar pick 50 comfortably against a user's finger.

Figure 14:
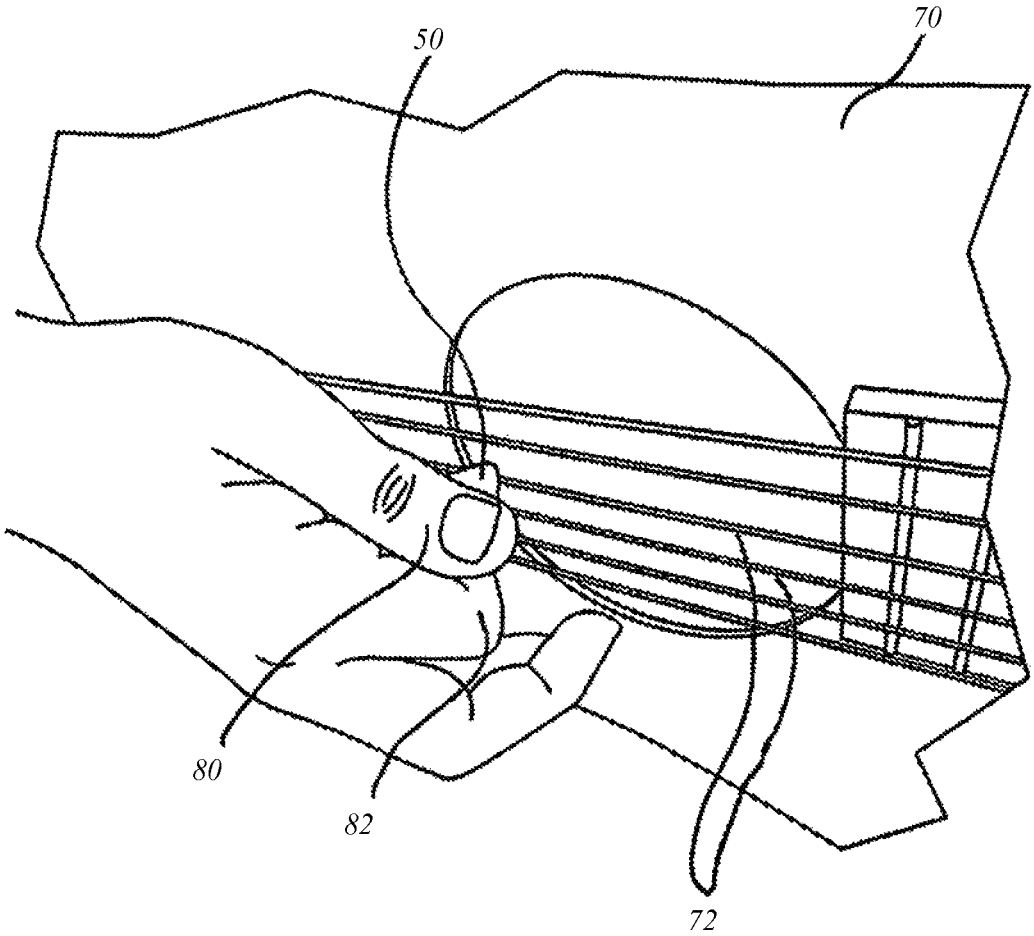
FIG. 14 is a drawing illustration of the guitar aid of FIGS. 7-12 positioned at a 90-degree angle for strumming guitar strings according to an embodiment of the present invention.

FIG. 14 further depicts a user playing a guitar 70 with a pick 50 with use of guitar aid 10. When the user is playing, the user engages the user's thumb 80 with the thumb engagement member 46 in addition to the engagement of the user's index finger 82 with the index finger engagement member 48. This dual engagement applies a fixed tension onto guitar pick 50 while strumming the strings 72 of the instrument. As noted above, in some embodiments the guitar pick 50 is positioned relative to the user's hand at a 90 degree angle to the guitar strings 72. Modifications may be made to the foregoing embodiments without departing from the basic aspects of the invention. The invention illustratively described herein may suitably be practiced in the absence of any element(s) not specifically disclosed herein. The terms and expressions which have been employed are used as terms of description and not of limitation and use of such terms and expressions do not exclude any equivalents of the features shown and described or portions thereof and various modifications are possible. Although the present invention has been specifically disclosed by representative embodiments and optional features, modification and variation of the concepts herein disclosed may be made, and such modifications and variations may be considered within the scope of this invention.

The invention claimed is:

1. A device to aid in playing a stringed instrument, comprising:

a ring defining an opening sized and shaped to fit around a finger of a user, the ring comprising a flexible material enabling a size of the opening to be adjusted; and a pick having an upper surface, a lower surface attached to the ring, a proximal end near the ring and a tapered distal end further from the ring, wherein the upper surface of the pick defines a raised portion adjacent the proximal end having a thickness between the upper surface and the lower surface greater than a thickness of the pick adjacent the raised portion and wherein the lower surface defines at least one rib projecting outwardly from the lower surface.

2. The device of claim 1, wherein the ring defines an arc having a pair of opposed ends with a space therebetween, the opening in the ring being adjustable by relative movement of the opposed ends.

3. The device of claim 1, wherein the proximal end of the pick has a first side and a second side, and wherein the ring is attached to the pick closer to the first side than the second side and the raised portion on the upper surface of the pick is positioned adjacent the first side.

4. The device of claim 1, wherein the raised portion on the upper surface of the pick is positioned above a point of attachment between the ring and the pick on the lower surface of the pick.

5. The device of claim 1, wherein the opening in the ring defines a central axis, and wherein the distal end of the pick is oriented at an approximately 45 degree angle with respect to the central axis of the opening.

6. The device of claim 1, wherein the lower surface defines a pair of ribs.

7. The device of claim 6, wherein the ribs are oriented generally parallel to each other and spaced apart to accommodate a user's finger there between.

8. The device of claim 6, wherein the distal end of the pick defines a playing tip, and wherein the ribs are oriented generally perpendicularly to the distal tip.

9. The device of claim 1, further comprising a rivet integrally attaching the ring to the pick.

10. A device to aid in playing a stringed instrument, comprising:

a ring defining an opening sized and shaped to fit around a finger of a user, the ring comprising a flexible material enabling a size of the opening to be adjusted; and a pick having a body portion, a thumb engagement feature on an upper surface of the body portion and an index finger engagement feature on the lower surface of the body portion, the thumb engagement feature and index finger engagement feature being engaged by a thumb and an index finger of a user, respectively, when the user's index finger is inserted through the ring and the user is grasping the pick between the user's thumb and index finger.

11. The device of claim 10, wherein the thumb engagement feature is a raised ridge extending upwardly from the upper surface of the body portion.

12. The device of claim 10, wherein the index finger engagement feature is defined by a pair of elongate ribs extending from the lower surface of the body portion.

13. The device of claim 12, wherein the ribs are oriented generally parallel to each other.

14. The device of claim 10, wherein the opening in the ring defines a central axis and wherein a distal end of the pick is oriented at an approximately 45 degree angle with respect to the central axis of the opening.

* * * * *